United States Patent [19]

Johnson

[11] Patent Number: 4,846,141

[45] Date of Patent: Jul. 11, 1989

[54] BOW SIGHT

[76] Inventor: Jerry Johnson, P.O. Box 400, Kooskia, Id. 83539

[21] Appl. No.: 190,674

[22] Filed: May 5, 1988

[51] Int. Cl.[4] ..... F41B 5/00

[52] U.S. Cl. ..... 124/87; 124/88; 33/265

[58] Field of Search ..... 124/87, 88, 89; 33/265

[56] References Cited

U.S. PATENT DOCUMENTS

| | | | |
|---|---|---|---|
| 3,521,362 | 7/1970 | Duplechin | 33/46 |
| 3,718,979 | 3/1973 | Allen | 33/265 |
| 3,787,984 | 1/1974 | Bear et al. | 33/265 |
| 4,120,096 | 10/1978 | Keiler | 33/265 |
| 4,224,741 | 9/1980 | Perry | 33/265 |
| 4,417,403 | 11/1983 | Strange | 124/87 |
| 4,532,717 | 8/1985 | Watson et al. | 33/265 |
| 4,535,747 | 8/1985 | Kudlacek | 124/87 |
| 4,584,777 | 4/1986 | Saunders | 124/87 |
| 4,643,160 | 2/1987 | Gray et al. | 124/90 |

OTHER PUBLICATIONS

Dec./Jan. 1987 advertisement illustrating "Game and Target Bowsight".

*Primary Examiner*—Randolph A. Reese
*Assistant Examiner*—Anthony Knight
*Attorney, Agent, or Firm*—James D. Givnan, Jr.

[57] ABSTRACT

A sight for archery bows including an elongate sight pin carrier having a guideway in which are adjustably carried a number of sight pin holders. The pin holders are of cruciform shape with a sight pin in threaded engagement therewith for lateral sight pin adjustment. A locking screw secures each pin holder to the pin carrier. For sighting in the sight, the pin carrier is tiltable in a vertical plane in one form of the sight to vary the viewed or apparent distance between the sight pins while in a second form of the invention, the pin carrier is slidably mounted on a bow mounted base. The base may define elongate intersecting slots for base and sight positioning along two courses.

11 Claims, 1 Drawing Sheet

BOW SIGHT

BACKGROUND OF THE INVENTION

The present invention relates generally to archery bow sights of the type using multiple pins for targets at different ranges.

In archery, it is common practice to utilize a plurality of vertically spaced pins or a single vertically adjustable pin for sighting of targets at different distances. In some sights, several pins will be used to provide the capability of aiming the bow at targets at various distances. Such sighting in of a bow with known sights can be a tedious, time-consuming effort.

In certain types of competition, the number of sighting pins permitted on the bow site are limited in number. The pins are vertically spaced a distance determined target range and arrow trajectory.

In some bow sights it has been proposed to mount a sight pin on a rotatable disk to provide vertical pin movement during sighting in of a target.

SUMMARY OF THE PRESENT INVENTION

The present invention is embodied within an archery sight including a pin carrier adjustably supporting several sight pins for movement in a vertical plane.

The present sight includes a base adapted for attachment to a sight mount on the bow. A pin carrier is adjustably mounted at the forward end of said base in a manner permitting movement of the carrier and sight pins therein in a vertical plane. The sight pins are slidably adjustable and lockable within the carrier. In the preferred embodiment of the invention, the carrier is rotatably mounted on the sight base to permit changes in the vertical spacing of the sight pins by rotation of the carrier about its pivot mount whereby sight pin spacing will automatically diminish as a series of sight pins is positioned toward the horizontal. A second form of the carrier is slidably mounted on the low mounted base to permit simultaneous vertical adjustment of all the sight pins while also permitting selective sight pin adjustment if so desired. Additionally, provision is made in both forms of the carrier for lateral positioning of the sight pins and locking same in the desired, laterally adjusted position. In both forms of the carrier, pin holders are utilized which are of a cruciform shape for sliding engagement with the carrier with provision made for locking each holder to the carrier.

Important objectives include the provision of an archery sight having multiple sight pins which may be simultaneously positioned in a vertical plane and/or independently positioned in said plane during sighting in of the bow; the provision of an archery sight utilizing sight pin holders of cruciform shape each receiving a sight pin adjustable and lockable within the holder with the holder additionally provided with means for locking the holder to the carrier; the provision of an archery sight having a carrier with multiple sight pins with the carrier being rotatably mounted on a base with the sight pins slidably disposed in the carrier in an adjustable and lockable manner and with said sight pins also being laterally adjustable in a horizontal plane.

DETAILED DESCRIPTION OF THE PREFERRED EMBODIMENTS

Figures 1, 1A, 2, 3, 4, 5, 6, 7, 8:
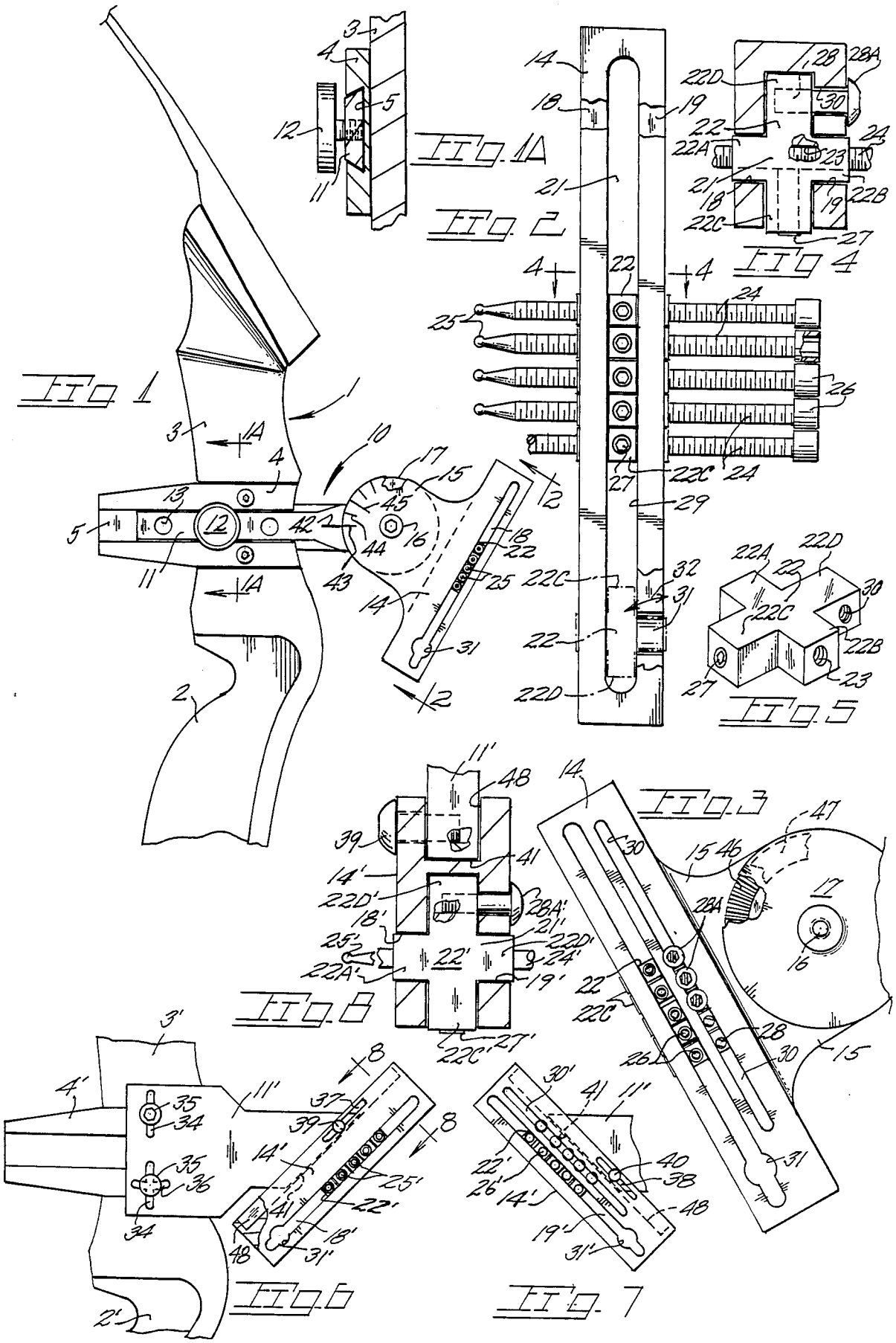
FIG. 1 is a fragmentary side elevational view of a compound bow with the present sight in place thereon.
FIG. 1A is a sectional view taken along line 1A—1A of FIG. 1.
FIG. 2 is an enlarged elevational view taken along line 2—2 of FIG. 1.
FIG. 3 is an enlarged side elevational view of the unseen side of the sight shown in FIG. 1.
FIG. 4 is a horizontal sectional view taken along line 4—4 of FIG. 2.
FIG. 5 is a perspective view of the pin holder.
FIG. 6 is a view similar to FIG. 1 but showing a modified form of sight.
FIG. 7 is a view similar to FIG. 6 but showing the unseen side of the sight viewed in FIG. 6.
FIG. 8 is a sectional view taken along line 8—8 of FIG. 6.

With continuing attention to the drawings wherein applied reference numerals indicate parts similarly hereinafter identified, the reference numeral 1 indicates generally an archery bow which may be of the compound type. The present sight is usable with any bow type. A handle at 2 of the bow is integral with a riser portion 3 which is commonly provided with a sight mounting plate 4 having a dovetail channel 5.

The preferred form of the present sight is indicated generally at 10 and includes a base 11 adapted for securement to the mounting plate at 4. For such securement, the base 11 corresponds in section to the dovetail channel 5 of the mounting plate with a thumbscrew 12 in threaded engagement with a base threaded bore as at 13 to bias the base 11 into engagement with the mounting plate. Additional base bores 13 permit fore and aft positioning of the base to suit the archer.

A sight pin carrier is indicated at 14 which is of elongate shape with a semi-circular flange at 15 projecting rearwardly. A fastener 16 joins the carrier in a pivoted manner with a circular head 17 at the forward end of base 11. Fastener 16 is in threaded engagement with a central bore in head 17 to permit frictional engagement between semi-circular flange 15 and circular head 17 to be varied. Indices on flange 15 may be aligned with indices on the base to facilitate setting of the pin carrier 14 to a desired inclination as later elaborated upon.

The pin carrier is of rectangular section, as best viewed in FIG. 4, defining a lengthwise extending guideway or open area 21 in which are carried positionable and lockable pin holders at 22. Carrier side slots are at 18–19. The holders 22 correspond in shape to the guideway formed in the pin carrier and are of cruciform shape with lateral extensions at 22A–22B and fore and aft extensions 22C–22D. The holders each define a transversely extending threaded bore at 23 to receive the threads of a sight pin 24 to permit lateral adjustment of the sight pin upon rotation of same. The sight pins include a bead at 25 for visual placement on a sighted target and a head 26 for reception of a tool facilitating pin rotation. A set screw at 27 acccessible through a carrier defined slot 29 locates the sight pin against rotation. For locking the pin holders in place in the carrier, each holder is equipped with a screw 28 the head 28A of which bears upon carrier surfaces adjacent a screw receiving slot 30 in the carrier. For holder installation into carrier guideway 21 during sight assembly, enlarged areas at 31 in the sides of the carrier receive lateral extensions 22A–22B to permit 90 degree rotation of each holder so the fore and aft extensions 22C–22D may be positioned (FIG. 2) for passage inwardly or outwardly through slots of the carrier per arrow at 32.

A modified form of sight as shown in FIGS. 6, 7 and 8 utilizes the same pin holders and accordingly the pin carrier at 14' defines an opening or guideway 21' of a cross section corresponding to the shape of the holder per FIG. 8. Parts earlier described in the preferred form of the invention are identified in the modified form of the invention by like prime reference numerals.

A modified base at 11' is secured to bow mounted mounting plate 4' which is typically provided with a pair of threaded bores for plate attachment to the bow. The modified base 11' is of plate configuration with openings to receive inset flat head screws 35 with a slot 36 permitting inclination of the base and slots 34 vertical positioning of the base. The forward end of the base carries pin carrier 14' with coupling means including elongate openings 37 and 38 on the carrier sides which receive screws 39–40 in threaded engagement with the distal or forward of base 11' shown as inclined in FIGS. 6 and 7 with interengaging surfaces embodied in base edge 41 and a rearwardly opening channel 48 which extends lengthwise along the rear edge of the carrier. Upon loosening of screws 39–40 pin carrier 14' may be positioned in a vertical plane. Optional vertical adjustment of the pin carrier 14' is achieved through movement of base 11' as permitted by upright elongate openings 34 which receive fasteners 35. Arcuate slot 36 permits base inclination about upper fastener 35.

To provide fine increments of rotational movement between flange 15 and circular head 17, as well as to resist accidental displacement of pin carrier 14, the opposed inner surfaces of said flange and head are each provided with fine, intermeshed radially disposed toothed ridges as at 46–47 which provide the feel and sound of incremental movement in click fashion. FIG. 3 shows a toothed ridge bearing surface typical of both the opposed inner surfaces of pin carrier flange 15 and base circular head 17.

In use, the pin carrier of the preferred form of sight is positionable about pivot 16 with the vertical spacing between top and bottom sight pin beads being about three quarters of an inch from top to bottom assuming pin carrier 14 is disposed vertically and sight pin holders are abutting one another. Such bead spacing is believed suitable for a majority of compound bows now in use. For bows providing higher velocities and hence flatter arrow trajectories, the apparent pin spacing (as appears to the eye) may be reduced by further rotation of the carrier about pivot 16, for example, to the inclined position of FIG. 1. Accordingly, the several horizontal planes, each containing a sight pin bead, will move closer to one another as the carrier is rotated toward the horizontal. Aligning a carrier reference line 43 and a pointer 42 on the base will provide top to bottom pin head spacing of one-half inch while aligning line 44 with pointer 42 will provide top to bottom pin bead spacing of five-eights inch. Aligning carrier line 45 with pointer 42 will provide the above noted pin bead spacing of three-quarters of an inch again assuming the pin holders are all in abutment. The indices shown in FIG. 1 above the middle line or indices (line 45) are for use when the sight is installed on the opposite side of the bow from that side shown in FIG. 1 as for a left-handed archer of if the pin carrier 14, when lowered or raised, constitutes any hinderance to arrow passage.

Sighting in a bow would usually entail the sighting of the lowermost sight pin bead 25 on a target at 60 yards with the upwardly adjacent beads being respectively and automatically located for 50, 40, 30 and 20 yard target distances assuming arrow velocity common to bows now in use. If necessary, the holders may be spaced apart to increase pin bead spacing where a bow produces a lower arrow velocity resulting in a more curved trajectory.

In the modified sight at 10', the screws 39–40 are loosened to permit carrier 14' to be adjusted. The pin holders 22' may be adjusted relative one another but in most instances will be in abutment. In bows providing slower arrow velocities, the pin carriers will be spaced as necessary. Additionally base 11' may be positioned by reason of elongated slots 34 and 36 to avoid interference with arrow passage or for sighting purposes.

While I have shown but a few embodiments of the invention, it will be apparent to those skilled in the art that the invention may be embodied still otherwise without departing from the spirit and scope of the invention.

Having thus described the invention, what is desired to be secured by a Letters Patent is:

1. An archery sight for bow attachment including,
a base adapted for bow attachment,
a pin carrier carried by said base including a guideway,
sight pins, and
pin holders of cruciform shape with fore and aft extensions and lateral extensions and each receiving one of said pins and slidably mounted in said guideway for positioning along the guideway to space said pins therealong for bow sighting at different target distances, locking means engageable with said carrier to lock said pin holders in place.

2. The archery sight claimed in claim 1 additionally including coupling means coupling said pin carrier to said base to permit adjustment of said pin carrier in a vertical plane relative said base.

3. The archery sight claimed in claim 2 wherein said coupling means includes a pivot pin having a horizontal axis.

4. The archery sight claimed in claim 3 wherein said pin carrier is rotatably positionable about said pivot pin with vertical spacing between horizontal planes containing each of said sight pins diminishing as the pin carrier is rotated off the vertical and toward the horizontal.

5. The archery sight claimed in claim 2 wherein said coupling means is embodied within interengaging surfaces on said base and said pin carrier and screw means for locking said pin carrier to said base in a selected position.

6. The archery sight claimed in claim 2 wherein said coupling means includes intermeshed radially disposed toothed ridges to facilitate incremental positioning of said pin carrier.

7. The archery sight claimed in claim 1 wherein said pin carrier defines a slot for the reception of said locking means, said locking means embodied in a screw having a head.

8. The archery sight claimed in claim 1 wherein said pin carrier includes slots formed therein partially defining said guideway and receiving said lateral extensions.

9. The archery sight claimed in claim 1 wherein said base defines elongate slots for the reception of fasteners for attaching said base to said bow in an adjustable manner.

10. The archery sight claimed in claim 9 wherein certain of said elongate slots are substantially normal to and intersecting other of said elongate slots to permit base adjustment along multiple courses.

11. In an archery bow sight including a base for bow attachment, the improvement comprising a pin carrier carried by said base and of elongate configuration and internally defining a guideway, sight pin holders of cruciform shape slidably mounted in said guideway, sight pins one each extending transversely through said holders, locking means carried by each of said sight pin holders.

* * * * *